US011831115B2

(12) United States Patent
Veigel

(10) Patent No.: US 11,831,115 B2
(45) Date of Patent: Nov. 28, 2023

(54) WIRE-CONNECTING ELEMENT

(71) Applicant: Andreas Veigel, Lenningen (DE)

(72) Inventor: Andreas Veigel, Lenningen (DE)

(73) Assignee: Andreas Veigel, Lenningen (DE)

( * ) Notice: Subject to any disclaimer, the term of this patent is extended or adjusted under 35 U.S.C. 154(b) by 97 days.

(21) Appl. No.: 17/601,750

(22) PCT Filed: Nov. 27, 2019

(86) PCT No.: PCT/EP2019/082661
§ 371 (c)(1),
(2) Date: Oct. 6, 2021

(87) PCT Pub. No.: WO2020/228974
PCT Pub. Date: Nov. 19, 2020

(65) Prior Publication Data

US 2022/0173531 A1 Jun. 2, 2022

(30) Foreign Application Priority Data

May 15, 2019 (DE) ..... 10 2019 112 697.5

(51) Int. Cl.
*H01R 4/14* (2006.01)
*H01R 12/58* (2011.01)

(52) U.S. Cl.
CPC ..... *H01R 4/14* (2013.01); *H01R 12/58* (2013.01)

(58) Field of Classification Search
CPC ..... H01R 4/14; H01R 12/58; H01R 12/585
See application file for complete search history.

(56) References Cited

U.S. PATENT DOCUMENTS 2,998,590 A * 8/1961 Buhrendorf ..... H01R 43/033 242/439.3
3,234,498 A * 2/1966 Logan ..... H01R 4/2429 439/402
3,288,915 A * 11/1966 Hatfield ..... H01R 4/48 439/43

(Continued)

FOREIGN PATENT DOCUMENTS

CN 86108502 A 7/1987
CN 102576951 A 7/2012

(Continued)

OTHER PUBLICATIONS

European Patent Office, Rijswijk, Netherlands, International Search Report of International Application No. PCT/EP2019/082661, dated Feb. 20, 2020, 2 pages.

*Primary Examiner* — Truc T Nguyen
(74) *Attorney, Agent, or Firm* — Dickinson Wright PLLC

(57) ABSTRACT

A wire-connecting element for connecting a metal wire to a circuit board or to an electrically conductive substrate via a connecting portion (V) of the wire-connecting element. The wire-connecting element has a two-zone portion (Z), which consists of a pre-mounting portion (B) and an adjoining final mounting portion (C). The pre-mounting portion (B) is designed for the attachment of a wire winding (IO). The final mounting portion (C) forms a contact region for the wire winding (IO), which wire winding, in the intended use, is moved, preferably pressed, onto the final mounting portion (C) after the wire winding (IO) has been attached around the pre-mounting portion (B).

20 Claims, 3 Drawing Sheets

(56) References Cited

U.S. PATENT DOCUMENTS 3,303,267 A * 2/1967 Coutu ..... H01R 4/14 174/251
3,649,743 A * 3/1972 O'Loughlin ..... H01R 4/14 174/94 R
3,780,211 A * 12/1973 Vernet ..... H05K 3/3478 439/83
3,786,402 A * 1/1974 Horecky ..... H01R 4/14 439/888
4,157,207 A * 6/1979 Robinson ..... H01R 12/716 439/82
4,274,702 A * 6/1981 Buck ..... H01R 13/422 439/600
4,824,390 A * 4/1989 Crane ..... H01R 13/5216 439/271
4,880,400 A * 11/1989 Baubles ..... H01R 4/34 439/888
4,906,198 A * 3/1990 Cosimano ..... H05K 1/115 439/85
5,015,204 A * 5/1991 Sakamoto ..... H01R 13/6633 439/620.21
5,037,333 A * 8/1991 Baubles ..... H04Q 1/142 439/888
5,042,146 A * 8/1991 Watson ..... H05K 3/222 29/850
5,796,324 A * 8/1998 Ross ..... H01F 27/292 439/397
5,967,835 A * 10/1999 Daoud ..... H01R 43/002 439/888
6,102,729 A * 8/2000 Daoud ..... H01R 4/2429 439/402
6,746,252 B1 * 6/2004 Scott ..... H01R 13/187 439/70
7,118,430 B1 * 10/2006 Henry ..... H01R 4/023 439/888
9,634,405 B2 * 4/2017 Horn ..... H01R 4/188
11,336,041 B2 * 5/2022 Shimizu ..... H01R 25/162
2005/0014421 A1 * 1/2005 Sweetland ..... H01R 4/58 439/775
2010/0068915 A1 * 3/2010 Kahl ..... H01R 4/2412 439/391
2010/0229381 A1 * 9/2010 Freakes ..... H01R 4/24 29/825
2012/0214356 A1 * 8/2012 Hasegawa ..... G01R 1/06738 439/817
2012/0322324 A1 12/2012 Freakes
2014/0141661 A1 * 5/2014 Veigel ..... H01R 13/114 439/884
2016/0049743 A1 2/2016 Betz
2019/0131723 A1 * 5/2019 Txarola ..... H01R 43/01
2020/0388943 A1 * 12/2020 He ..... H01R 13/03

FOREIGN PATENT DOCUMENTS

CN 103688416 A 3/2014
CN 104540545 A 4/2015
DE 1262399 B 3/1968
DE 1790148 A1 1/1972
DE 3623453 A1 1/1988
DE 29813444 U1 10/1998
DE 20218295 U1 4/2003
DE 102004028202 A1 12/2005
DE 102013103818 A1 10/2014
DE 102015211388 A1 12/2016
EP 0451674 A1 10/1991
FR 1156206 A 5/1958
GB 2195836 A 4/1988
WO 2005122337 A1 12/2005
WO 2014170035 A1 10/2014

* cited by examiner

WIRE-CONNECTING ELEMENT

CROSS REFERENCE TO RELATED APPLICATIONS

This application is a 35 U.S.C. § 371 national phase application of International Application No.: PCT/EP2019/082661, filed Nov. 27, 2019, which claims the benefit of priority under 35 U.S.C. § 119 to German Patent Application No.: 10 2019 112 697.5, filed May 15, 2019, the contents of which are incorporated herein by reference in their entirety.

FIELD

The invention relates to a wire-connecting element, particularly to a wire-connecting element for connecting a metallic wire to a printed circuit board or an electrically conductive substrate.

BACKGROUND

The statements in this section merely provide background information related to the present disclosure and several definitions for terms used in the present disclosure and may not constitute prior art.

Known contacts for connection to printed circuit boards, such as press-in contacts, require expensive tools with precisely defined dimensions. Press-in contacts are disclosed in several publications, such as EP 0451 674 or DE 36 23 453. One of the main disadvantages of such solutions is that, as explained above, the production tools are very expensive and, at the same time, dimensionally inflexible, which in turn requires complex development in order to achieve the optimal final dimensions of the press-in contact.

A press-in contact and a method for producing a press-in contact are disclosed in WO 2005 122 337 A1. The known press-in contact comprises a contact body and two legs that are integrally formed therewith and formed by means of non-cutting machining, with no direct connection being able to be made to a metallic wire by means of such a contact without the aid of known joining methods such as soldering, welding, or the like.

DE 202 18 295 U1 and DE 102013103818 A1 disclose further press-in contact elements with which it is not possible, however, to permanently and securely connect wire without resorting to conventional integral joining methods with an additional filler material.

Press-in connections, for example, can be used to at least partially substitute for material-locking processes, such as soldered connections. Press-in connections can usually be produced with the formation of both a force-fit component and a form-fit component. At least minimal deformations can occur in the press-in contact and/or the associated contact receptacle, which can contribute to an increase in the holding force and an enlargement of the contact surface. Unfortunately, however, there is no satisfactory solution in the prior art for substituting for material-locking processes, such as soldered connections, on the terminal side of the contact as well.

SUMMARY

The object of the present disclosure is to provide a wire-connecting element, particularly a direct connecting element for connecting a metallic wire to a printed circuit board or an electrically conductive substrate, the connecting element being embodied so as to be pluggable directly into a bore or contact zone in a printed circuit board or embodied with a contact zone for connecting to a substrate. A further object of the present invention is to propose a method for producing such connections with a wire-connecting element.

The present disclosure discloses a wire-connecting element for connecting a metallic wire to a printed circuit board or an electrically conductive substrate via a connecting portion (V) of the wire-connecting element, the wire-connecting element having a two-zone portion (Z) consisting of a pre-mounting portion (B) and an adjoining final mounting portion (C), wherein the pre-mounting portion (B) is designed for the attachment of a wire winding, and wherein the final mounting portion (C) forms a contact region for the wire winding, which, after the wire winding has been attached around the pre-mounting portion (B), is moved in the intended manner, preferably pressed, onto the final mounting portion (C).

The present disclosure further discloses a method for producing the wire connection of a wire with a wire-connecting element as set forth above and further defined herein, with the following steps:

a. Producing a wire winding of r windings (W1, W2, . . . , Wr) around the pre-mounting zone (B) with a wire such that the wire of the wire winding, after winding, preferably rests against the outer surface of the pre-mounting zone (B) over the entire winding portion, and b. moving the wire winding produced in this manner from the pre-mounting zone (B) to the final mounting zone (C), wherein any real or natural number is greater than 2 but selected at most such that the wire winding, when viewed in the direction of longitudinal extension of the wire-connecting element, is at most as long as the final mounting zone (C) when viewed in this direction.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

In order that the disclosure may be well understood, there will now be described various forms thereof, given by way of example, reference being made to the accompanying drawings, in which.

Figure 1:
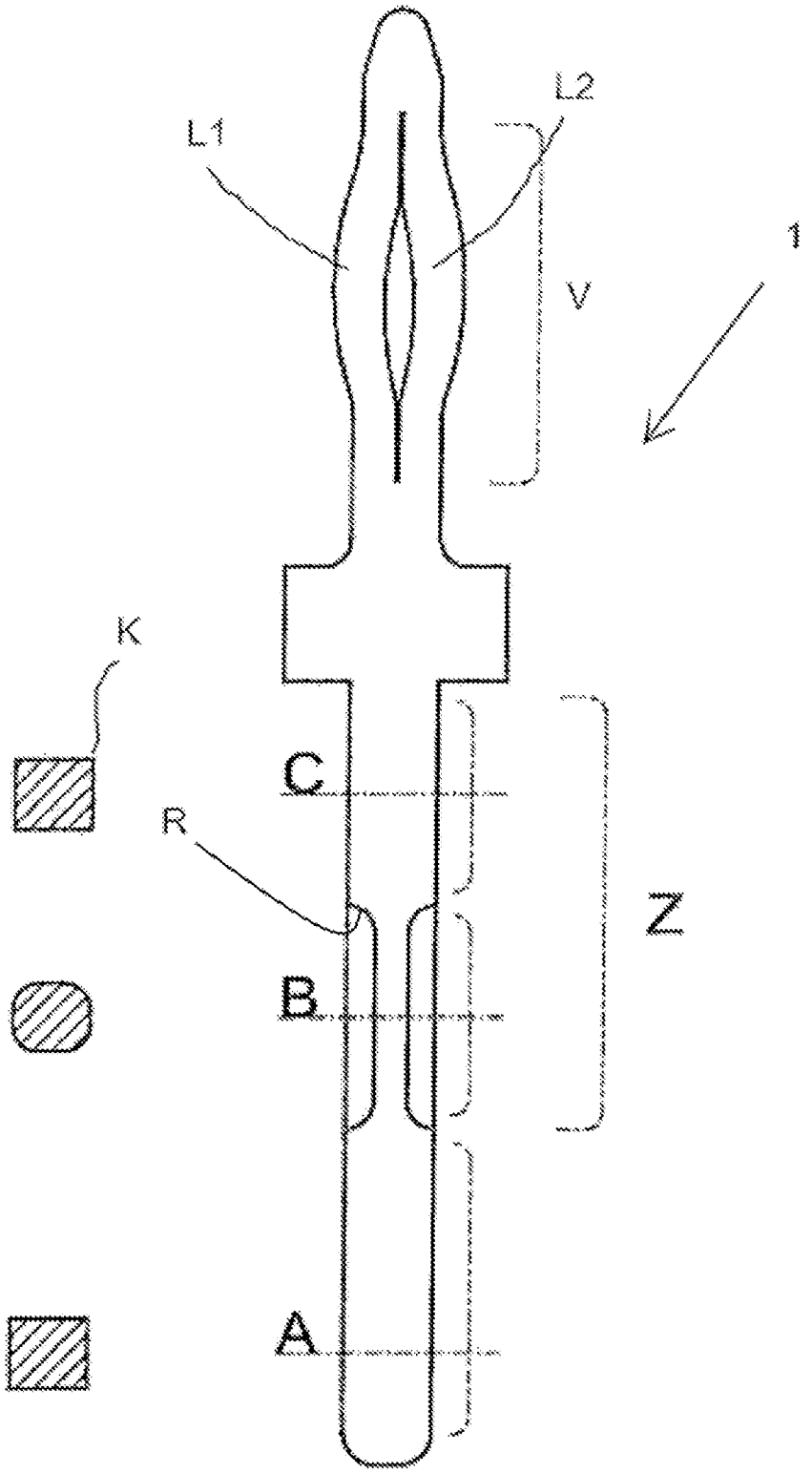
FIG. 1 shows a wire-connecting element according to the present disclosure in a first view.

The drawings are provided herewith for purely illustrative purposes and are not intended to limit the scope of the present invention.

DETAILED DESCRIPTION

The following description is merely exemplary in nature and is in no way intended to limit the present disclosure or its application or uses. It should be understood that throughout the description, corresponding reference numerals indicate like or corresponding parts and features.

Within this specification, embodiments have been described in a way which enables a clear and concise specification to be written, but it is intended and will be appreciated that embodiments may be variously combined or separated without parting from the invention. For example, it will be appreciated that all preferred features described herein are applicable to all aspects of the invention described herein.

The present disclosure relates to a wire-connecting element, particularly to a wire-connecting element for connecting a metallic wire to a printed circuit board or an electrically conductive substrate, the wire-connecting element being designed for this purpose to be plugged directly into a bore or substantially round contact zone in a printed circuit board in order to produce a printed circuit board plug connection.

A core of the present disclosure, however, relates to the zone of such a wire-connecting element, which is designed to contact and establish a permanent electrical connection with a wire (particularly one that is electrically conductive). The basic idea of the present invention consists in the specific geometric configuration of such a wire connection zone.

Proposed according to the present disclosure is a wire-connecting element for connecting a metallic wire to a printed circuit board or an electrically conductive substrate via a connecting portion of the wire-connecting element, the wire-connecting element having a two-zone portion consisting of a pre-mounting portion (B) and an adjoining final mounting portion (C), the pre-mounting portion being designed for the attachment of a wire winding, and the final mounting portion forming a contact region for the wire winding in that, after the wire winding has been attached around the pre-mounting portion, it is moved in the intended manner, preferably pressed, onto the final mounting portion in order to form a contact connection there.

It is particularly advantageous if the wire-connecting element has a substantially cylindrical and elongated shape in the vicinity of the two-zone portion. In the simplest case, this can be an elongated contact pin.

In a particularly advantageous embodiment of the present disclosure, a provision is made that, in the vicinity of the final mounting zone, the wire-connecting element has a preferably square cross section with multiple edges and with an outer circumference $A_C$ that is substantially constant in the direction of longitudinal extension as viewed in the circumferential direction around its central axis.

According to the present disclosure, it is therefore advantageous if, in the vicinity of the pre-mounting zone, the wire-connecting element has a preferably square cross section with rounded edges or a round cross section and with an outer circumference $A_B$ that is substantially constant in the direction of longitudinal extension L as viewed in the circumferential direction around its central axis.

According to another aspect of the present disclosure, a provision is made that the outer circumference $A_B$ of the pre-mounting zone is smaller than the outer circumference $A_C$ of the final mounting zone and increases continuously at the transition to the final mounting zone, preferably in the form of a circumferential ramp.

It is also advantageous if the wire-connecting element has a wire winding around the final mounting zone that was pushed onto the final mounting zone after the production of r (adjacently arranged) windings around the pre-mounting zone, the edges preferably having penetrated the wire of the wire winding at least partially.

It is also advantageous if the connecting portion of the wire connecting element forms a circuit board connection, preferably in the form of two legs that are furthermore preferably connected at the plug-side leg end or at least touch one another there on the circuit board in the contacting state.

Another aspect of the present disclosure relates to a method for producing a wire connection of a wire with a wire-connecting element according to one of the preceding claims with the following steps:

a. Producing a wire winding of r windings around the pre-mounting zone with a wire such that the wire of the wire winding, after winding, preferably rests against the outer surface of the pre-mounting zone over the entire winding portion, and
b. moving the wire winding produced in this manner from the pre-mounting zone to the final mounting zone, where any real or natural number is greater than 2 but selected at most such that the wire winding, when viewed in the direction of longitudinal extension of the wire-connecting element, is at most as long as the final mounting zone when viewed in this direction.

The invention will be explained in greater detail below with reference to FIGS. 1 to 3, with same reference symbols in the figures indicating same functional and/or structural features.

Figure 2:
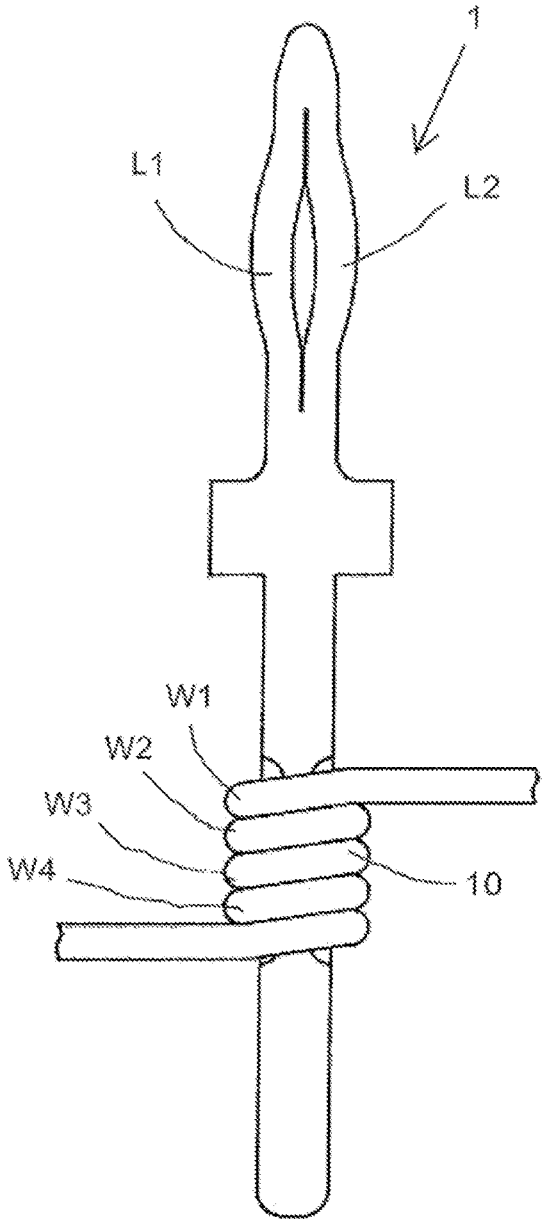
FIG. 2 shows a wire-connecting element according to the present disclosure in a view in which the wire winding has been formed around the pre-mounting zone.
Figure 3:
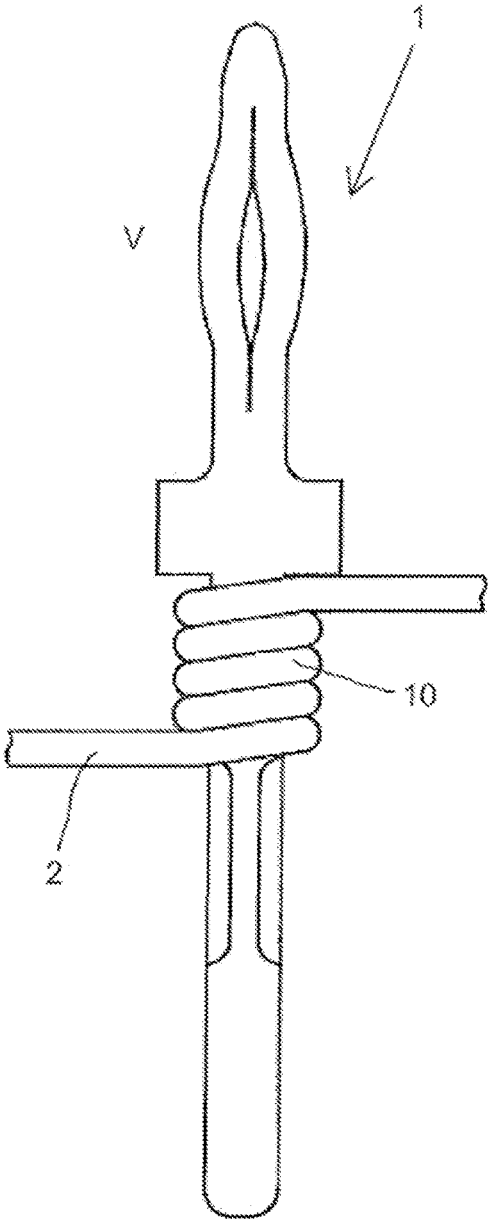
FIG. 3 shows the wire-connecting element according to FIG. 2 in a view in which the wire winding has been manipulated, i.e., moved, into the contacting final mounting zone.
Figure 4:
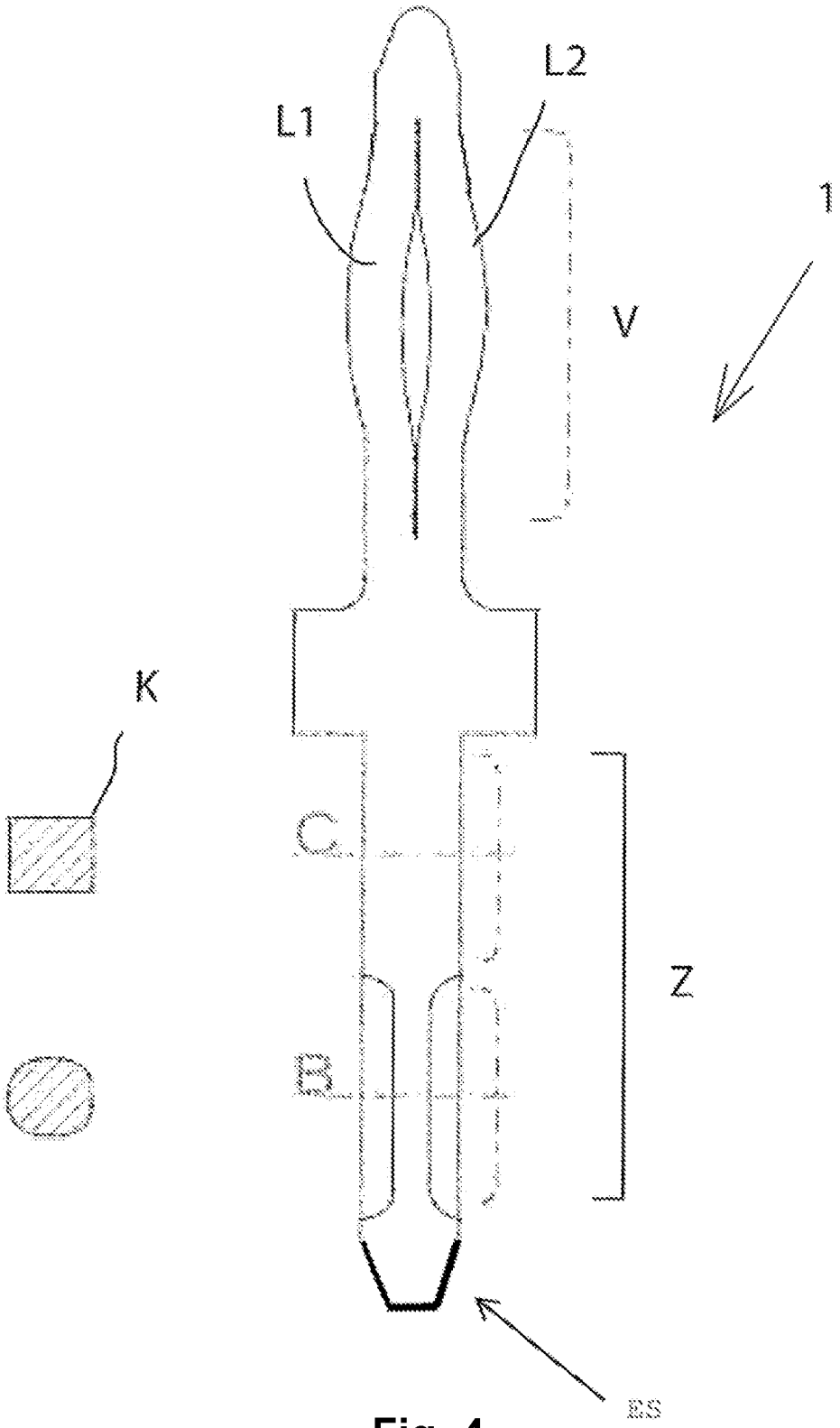
FIG. 4 shows an alternative embodiment of a wire-connecting element according to the present disclosure.

A first embodiment of a wire connecting element 1 according to the present disclosure is shown in FIGS. 1 to 3. An alternative embodiment of a wire-connecting element 1 according to the present disclosure is shown in FIG. 4.

When viewed from below upward, this wire-connecting element 1 has a holding area A for holding the wire-connecting element 1 during winding. This is followed by the two-zone portion Z consisting of the pre-mounting portion B and the final mounting portion C connected thereto. The function of the two-zone portion Z can be seen from the illustrations of FIGS. 2 and 3.

The pre-mounting portion B is designed for attaching the wire winding 10, which, merely by way of example, is composed here of four whole windings (W1, W2, W3, and W4).

The final mounting portion C has a larger outer circumference compared to the pre-mounting portion B and forms the contact region for the wire winding 10 after it has been pushed or pressed in the intended manner by the pre-mounting portion B onto the final mounting portion C.

FIG. 1 also shows the cross-sectional areas of the wire-connecting element 1, it being apparent that this has a rectangular cross section with edges K (four in this case) in the vicinity of the final mounting zone C and has an outer circumference $A_C$ that is substantially constant in the direction of longitudinal extension L as viewed in the circumferential direction about its center axis. The wire-connecting element 1 has a rectangular cross section with clearly rounded edges in the vicinity of the pre-mounting zone B. The connecting portion V with the two legs L1, L2 adjoins the final mounting zone C.

In FIG. 4, the area A is omitted as a holding area, and this area is replaced by an insertion area, particularly with an insertion tip ES—e.g., for inserting and pressing into a wire winding.

However, the invention is not limited in its execution to the abovementioned preferred exemplary embodiment. Rather, a number of variants and embodiments are conceivable which make use of the illustrated solution and the illustrated method even in the form of a fundamentally different design.

The invention claimed is:

1. A wire-connecting element for connecting a metallic wire to a printed circuit board or an electrically conductive substrate via a connecting portion (V) of the wire-connecting element, the wire-connecting element having a two-zone portion (Z) consisting of a pre-mounting zone (B) and an adjoining final mounting zone (C), wherein the pre-mounting zone (B) is designed for the-attachment of a wire winding, and wherein the final mounting zone (C) forms a contact region for the wire winding, which, after the wire winding has been attached around the pre-mounting zone (B), the wire winding is moved onto the final mounting zone (C).

2. The wire-connecting element as set forth in claim 1, characterized in that the wire-connecting element has a substantially cylindrical and elongated shape in a vicinity of the two-zone portion (Z).

3. The wire-connecting element as set forth in claim 1, characterized in that, in a vicinity of the final mounting zone (C), the wire-connecting element has a preferably square cross section with multiple edges (K) and with an outer circumference AC that is substantially constant in the direction of longitudinal extension L as viewed in the circumferential direction around its central axis.

4. The wire-connecting element as set forth in claim 1 characterized in that, in a vicinity of the pre-mounting zone (B), the wire-connecting element has a preferably square cross section with rounded edges or a round cross section and with an outer circumference AB that is substantially constant in the direction of longitudinal extension L as viewed in the circumferential direction around its central axis.

5. The wire-connecting element as set forth in claim 1, characterized in that an outer circumference AB of the pre-mounting zone (B) is smaller than an outer circumference AC of the final mounting zone (C) and increases continuously at a transition to the final mounting zone (C), preferably in a form of a circumferential ramp (R).

6. The wire-connecting element as set forth in claim 1, characterized in that the final mounting zone (C) of the wire-connecting element includes multiple edges (K); wherein the wire winding, after the production of r windings (W1, W2, . . . , Wr) of a wire around the pre-mounting zone (B), is pushed onto the final mounting zone (C), such that the multiple edges (K) preferably penetrate the wire of the wire winding at least partially.

7. The wire-connecting element as set forth in claim 1, characterized in that the connecting portion (V) of the wire-connecting element forms a circuit board connection, preferably in the form of two legs (L1, L2) that are furthermore preferably connected at a plug-side leg end or at least touch one another there on the circuit board in the contacting state.

8. A method for producing a wire connection of a wire with a wire-connecting element as set forth in claim 1, with the following steps:

a. Producing a wire winding of r windings (W1, W2, . . . , Wr) around the pre-mounting zone (B) with a wire such that the wire of the wire winding, after winding, preferably rests against the outer surface of the pre-mounting zone (B) over the entire winding portion, and b. moving the wire winding produced in this manner from the pre-mounting zone (B) to the final mounting zone (C), wherein r in r windings represents any real or natural number that is greater than 2 but selected at most such that the wire winding, when viewed in the direction of longitudinal extension of the wire-connecting element, is at most as long as the final mounting zone (C) when viewed in this direction.

9. The wire-connecting element as set forth in claim 2, wherein in a vicinity of the final mounting zone (C), the wire-connecting element has a preferably square cross section with multiple edges (K) and with an outer circumference AC that is substantially constant in the direction of longitudinal extension L as viewed in the circumferential direction around its central axis.

10. The wire-connecting element as set forth in claim 2 characterized in that, in a vicinity of the pre-mounting zone (B), the wire-connecting element has a preferably square cross section with rounded edges or a round cross section and with an outer circumference AB that is substantially constant in a direction of longitudinal extension L as viewed in the circumferential direction around its central axis.

11. The wire-connecting element as set forth in claim 3 characterized in that, in a vicinity of the pre-mounting zone (B), the wire-connecting element has a preferably square cross section with rounded edges or a round cross section and with an outer circumference AB that is substantially constant in a direction of longitudinal extension L as viewed in the circumferential direction around its central axis.

12. The wire-connecting element as set forth in claim 3, characterized in that the wire-connecting element has a wire winding around the final mounting zone (C), which, after the production of r windings (W1, W2, . . . , Wr) around the pre-mounting zone (B), is pushed onto the final mounting zone (C), the multiple edges (K) in the vicinity of the final mounting zone (C), preferably penetrating the wire of the wire winding at least partially.

13. The wire-connecting element as set forth in claim 5, characterized in that the wire-connecting element has a wire winding around the final mounting zone (C), which, after the production of r windings (W1, W2, . . . , Wr) around the pre-mounting zone (B), is pushed onto the final mounting zone (C), the edges (K) preferably penetrating the wire of the wire winding at least partially.

14. The wire-connecting element as set forth in claim 3, characterized in that the connecting portion (V) of the wire-connecting element forms a circuit board connection, preferably in the form of two legs (L1, L2) that are furthermore preferably connected at a plug-side leg end or at least touch one another there on the circuit board in the contacting state.

15. The wire-connecting element as set forth in claim 6, wherein the connecting portion (V) of the wire-connecting element forms a circuit board connection, preferably in the form of two legs (L1, L2) that are furthermore preferably connected at a plug-side leg end or at least touch one another there on the circuit board in the contacting state.

16. The method according to claim 8; wherein the wire-connecting element has a substantially cylindrical and elongated shape in the vicinity of the two-zone portion (Z).

17. The method according to claim 8, wherein in a vicinity of the final mounting zone (C), the wire-connecting element has a preferably square cross section with multiple edges (K) and with an outer circumference AC that is substantially constant in a direction of longitudinal extension L as viewed in a circumferential direction around its central axis.

18. The method according to claim 8, wherein in a vicinity of the pre-mounting zone (B), the wire-connecting element has a preferably square cross section with rounded edges or a round cross section and with an outer circumference AB that is substantially constant in a direction of longitudinal extension L as viewed in a circumferential direction around its central axis.

19. The method according to claim 8, wherein an outer circumference AB of the pre-mounting zone (B) is smaller than the outer circumference AC of the final mounting zone (C) and increases continuously at the transition to the final mounting zone (C), preferably in the form of a circumferential ramp (R).

20. The method according to claim 8, wherein the wire-connecting element has a wire winding around the final mounting zone (C), which, comprises a production of r windings (W1, W2, . . . , Wr) around the pre-mounting zone (B), that are pushed onto the final mounting zone (C), the final mounting zone (C) having multiple edges (K) that preferably penetrate the wire of the wire winding at least partially.

* * * * *